US006073405A

United States Patent [19]

Kasai et al.

[11] Patent Number: 6,073,405

[45] Date of Patent: Jun. 13, 2000

[54] FITTING FOR EFFECTING BOLTED CONNECTION BETWEEN A BEAM AND A COLUMN IN A STEEL FRAME STRUCTURE

[75] Inventors: Kazuhiko Kasai, King of Prussia, Pa.; David S. Bleiman, San Francisco, Calif.

[73] Assignee: ICF Kaiser Engineers, Inc., Oakland, Calif.

[21] Appl. No.: 08/577,809

[22] Filed: Dec. 22, 1995

[51] Int. Cl.[7] ..... E04H 1/00; E04B 1/19

[52] U.S. Cl. ..... 52/283; 52/655.1; 52/653.1; 403/270

[58] Field of Search ..... 52/656.9, 736.2, 52/650.1, 712, 514, 653.1, 656.1, 657, 655.01, 283, 720.1, 726.1–726.3, 745.03, 741.1; 403/231, 262, 205, 270; 211/182; 248/200, 235, 903

[56] References Cited

U.S. PATENT DOCUMENTS

| | | | |
|---|---|---|---|
| 471,610 | 3/1892 | Hart . | |
| 508,280 | 11/1893 | Cavallaro . | |
| 1,899,799 | 2/1933 | Edwards . | |
| 2,146,333 | 2/1939 | Deming . | |
| 2,456,055 | 12/1948 | Farrar . | |
| 2,619,687 | 12/1952 | Kahn | 52/217 |
| 3,194,527 | 7/1965 | Gruss . | |
| 3,674,289 | 7/1972 | Geraci . | |
| 3,938,297 | 2/1976 | Sato et al. . | |
| 3,945,741 | 3/1976 | Wendt . | |
| 3,960,458 | 6/1976 | Sato et al. . | |
| 4,014,089 | 3/1977 | Sato et al. . | |
| 4,068,964 | 1/1978 | Stoker . | |
| 4,074,947 | 2/1978 | Matake et al. . | |
| 4,111,578 | 9/1978 | Sato et al. . | |
| 4,220,419 | 9/1980 | Hawes . | |
| 4,347,015 | 8/1982 | Olashaw . | |
| 4,513,554 | 4/1985 | Johnson et al. | 52/657 |
| 4,530,194 | 7/1985 | Linton et al. | 52/712 |
| 4,893,961 | 1/1990 | O'Sullivan et al. . | |
| 4,905,436 | 3/1990 | Matsuo et al. . | |
| 5,020,678 | 6/1991 | Klein . | |
| 5,364,312 | 11/1994 | Cunard et al. | 52/712 X |
| 5,412,913 | 5/1995 | Daniels et al. | 52/712 X |

FOREIGN PATENT DOCUMENTS

| | | |
|---|---|---|
| 29 40 030 | 4/1981 | Germany . |
| 2 132 073 | 7/1984 | United Kingdom . |

*Primary Examiner*—Richard Chilcot

*Attorney, Agent, or Firm*—Burns, Doane, Swecker & Mathis, L.L.P.

[57] ABSTRACT

A fitting for effecting a bolted connection between a beam and a column in a steel frame structure includes a beam connecting portion and a column connecting portion. In addition, reinforcing elements are provided to strengthen the bracket and resist vertical eccentricity and loading caused by the particular bolted connection. The various embodiments of the bracket are particularly useful in the context of repairing cracked or damaged weld connections at the beam/column interface in existing steel structures, but have application in the context of upgrading or reinforcing existing weld connections that may not otherwise be damaged. Also, the bracket can be used in new steel frame constructions.

18 Claims, 8 Drawing Sheets

FITTING FOR EFFECTING BOLTED CONNECTION BETWEEN A BEAM AND A COLUMN IN A STEEL FRAME STRUCTURE

FIELD OF THE INVENTION

The present invention relates generally to steel frame structures such as buildings and the like. More particularly, the present invention pertains to a bracket fitting for use in steel frame structures to effect a bolted connection between a beam and a column.

BACKGROUND OF THE INVENTION

Steel frame structures such as buildings and the like are typically constructed with a welded connection between the beams and columns. While this welded connection is typically satisfactory under most normal loading conditions, it has been found to be inadequate under excessive and abnormal loading conditions such as those that occur during earthquakes. The high loading forces placed on the welded beam/column connections during earthquakes are oftentimes sufficient to fracture or otherwise damage the welded connections leading to premature loss of structural integrity. Typically, welding has been relied upon as the method for repairing these damaged welds. The repair can be in the form of a simple reweld or can involve a more elaborate and more expensive welding scheme. However, these approaches to repairing welded connection joints are inadequate and fraught with a variety of disadvantages and drawbacks.

In one respect, welding the damaged joint connection between a beam and a column in an existing building presents the danger of fires since welding gives off a significant amount of heat. In addition, if this occurs, the automatic sprinkler systems in the building can be set off. The result to the existing building is not only fire damage, but water damage as well.

In addition, welding the damaged connection joint provides a rather limited range of structural performance in a variety of contexts such as plastic rotational capacity. Also, the repair of the damaged connection can be somewhat time consuming, can create highly objectionable fumes, and can otherwise cause disturbance to the tenants in the occupied structures. Further, in the context of rewelds, the weld that is applied to repair the damaged connection joint may not be any more reliable than the welded connection joint in existence prior to the damage. Thus, it is likely that the repaired connection joint will be susceptible to the same damage causing forces as the original welded connection.

The damage caused by earthquakes has led at least one city to enact an ordinance requiring the inspection of a large number of steel moment frame buildings for purposes of identifying inadequate constructions. This inspection has revealed cracked welds in the buildings not necessarily attributable to earthquake damage, but rather the result of poor construction. While this non-earthquake related damage may not affect the structural integrity and viability of the buildings at the present time, the buildings are certainly more readily susceptible of damage during future earthquakes. Thus, the ordinance requires that the buildings be repaired which, in accordance with current practices, means that the damaged joint must be rewelded.

In view of the foregoing, a need exists for facilitating the repair of damaged buildings, including those resulting from earthquakes and those which simply have been poorly constructed. More particularly, a need exists for a way of repairing damaged weld connections between beams and columns in a steel frame structure that is not susceptible of the same disadvantages and drawbacks associated with rewelding the existing damaged weld joint.

One type of beam/column connection that has been proposed in the past is disclosed in U.S. Pat. No. 3,938,297 to Sato et al. The connection involves a T-shaped member that is used to provide a bolted connection between the beam and the column. While this type of connecting member possesses the ability to be used in the context of new building constructions, it is not at all suited for use in repairing damaged beam/column weld connections in a steel moment frame building. That is because the configuration and construction of the connecting member does not lend itself to being placed at an existing beam/column interface. Rather, the construction of the connecting member is such that in order to utilize it in the context of repairing an existing weld, the existing weld would have to be torched and completely removed to separate the beam from the column. In addition, it would likely be necessary to remove a portion of the beam so that the connecting element can be fitted in place. As can be appreciated, this does not really represent a viable solution to the repair of damaged buildings. Indeed, it would be much easier to simply reweld the damaged weld joint.

A need exists, therefore, for a way of repairing a damaged weld connection between a beam and a column through use of a bolted connection. It would also be preferable if the solution was also adaptable for use in connection with the construction of new steel frame structures to thereby provide a rigid moment connection having a wide range of uses.

SUMMARY OF THE INVENTION

One aspect of the present invention involves a method of repairing a damaged weld connection between a beam and a column in an existing steel frame structure. The method involves providing a bracket having a beam connecting plate and a column connecting element extending from the beam connecting plate, with the beam connecting plate having an outer surface and being provided with a plurality of through holes, and with the column connecting element having an outer surface and being provided with at least two through holes. At least two through holes are formed in the flange of the column of the existing steel frame structure and a plurality of through holes are formed in the flange of the beam of the existing steel frame structure. The bracket is positioned so that the outer surface of the beam connecting element faces the flange of the beam and the outer surface of the column connecting plate faces the flange of the column. The beam connecting element is then connected to the flange of the beam of the existing steel frame structure by providing a plurality of bolted connections each extending through one of the holes in the beam connecting plate and one of the holes in the flange of the beam. The column connecting element is connected to the flange of the column of the existing steel frame structure by providing a plurality of bolted connections each extending through one of the holes in the column connecting element and one of the through holes in the flange of the column. The present invention also has application to the construction of new steel frame structures in which the bracket is connected to the beam and the beam is then placed against the column flange and bolted thereto.

In accordance with another aspect of the invention, a fitting for connecting together a beam and a column in a steel frame structure includes a one piece L-shaped bracket having a horizontal beam connecting element for being connected to a beam forming a part of a steel structure and a vertical column connecting element for being connected to a column forming a part of the steel structure. The horizontal beam connecting element has an outer surface adapted to face the flange of the beam and the vertical column connecting element has an outer surface adapted to face the flange of the column. The L-shaped bracket has an inner corner formed by the intersection of the beam connecting element and the column connecting element, and an outer corner edge adapted to be positioned at the corner formed between the beam and the column. The column connecting element is provided with a plurality of through holes formed in two rows for alignment with holes in the flange of the column to provide a bolted connection between the column connecting element and the flange of the column. A reinforcing element extends between the column connecting element and the beam connecting element, with the reinforcing element being positioned between the two rows of holes in the column connecting element. The reinforcing element extends along the column connecting element from the inner corner to a point closely adjacent an upper free end of the column connecting element, and extends along the beam connecting element from the inner corner to a point closely adjacent a free end of the beam connecting element.

According to another aspect of the invention, a fitting for connecting together a beam and a column in a steel frame structure includes a bracket defined by a plate, a column connecting element and reinforcing ribs. The plate has a first surface adapted to face the beam flange and an oppositely positioned second surface, and the column connecting element is positioned on and extends from the second surface of the plate. The plate has oppositely positioned first and second ends and the column connecting element has oppositely positioned first and second end surfaces. The first end surface of the column connecting element is in substantial alignment with the first end of the plate and the bracket has an outer corner edge adapted to be positioned at a corner formed between the beam and the column. The column connecting element is provided with a through hole for alignment with a hole in the flange of the column to effect a bolted connection between the column connecting element and the flange of the column. The reinforcing ribs are spaced apart and interconnect the plate and the column connecting element. The reinforcing ribs are positioned on opposite sides of the longitudinal axis of the through hole in the column connecting element, and the reinforcing elements extend beyond the second end surface of the column connecting element towards the second end of the plate.

BRIEF DESCRIPTION OF THE DRAWING FIGURES

The foregoing and other features of the present invention will become more apparent from the detailed description set forth below considered in conjunction with the accompanying drawing figures in which like elements are designated by like reference numerals and wherein.

DETAILED DESCRIPTION OF THE INVENTION

The present invention provides a fitting for effecting a bolted connection between a beam and a column in a steel frame structure. As described below in more detail, the fitting according to the present invention is particularly advantageous for use in repairing cracked or otherwise damaged weld connections in an existing steel frame construction. The fitting also has application in the context of existing steel structures which, although not damaged, may nevertheless require reinforcement. Further, the fitting is applicable to new steel frame constructions to provide a rigid moment frame connection.

Figure 1:
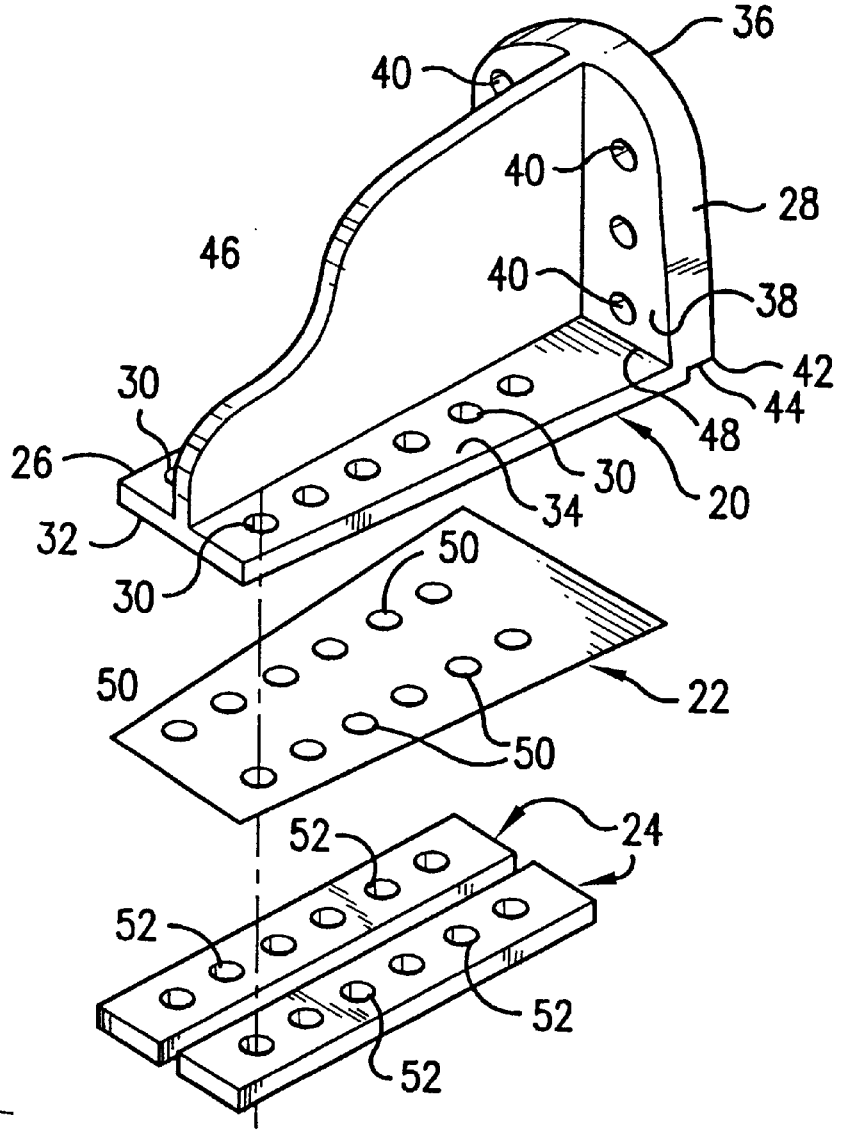
FIG. 1 is an exploded view of a fitting in accordance with one embodiment of the present invention for effecting a bolted connection between a beam and a column in a steel frame structure.

One embodiment of the fitting according to the present invention is illustrated in FIG. 1 and includes a bracket 20, a brass plate 22 and a pair of extended washer plates 24. As described below in more detail, the bracket 20 is adapted to be positioned on the outwardly facing surface of the beam flange for being connected to the beam flange. The brass plate 22 and the extended washer plates 24 are utilized during the bolted connection of the bracket 20 to the beam flange.

The bracket 20 is comprised of a beam connecting element or portion 26 and a column connecting element or portion 28. The beam connecting portion 26 consists of a flat planar plate having a beam flange facing surface 32 that is adapted to face the beam flange and an oppositely positioned surface 34. The beam connecting portion 26 is provided with two series of through holes 30 that are adapted to receive bolts for connecting the beam connecting portion 26 to the outwardly facing surface of the beam flange. The through holes 30 are arranged in two rows, with most of the holes in each row being linearly arranged. It has been found that the forwardmost hole 30 in each row can be offset inwardly towards one another (i.e., towards the reinforcing rib) to place such holes closer to the beam web to thereby inhibit or resist net section failure.

The column connecting portion 28 is also comprised of a generally planar plate member having a column flange facing surface 36 that is adapted to face the outwardly facing surface of the column flange and an oppositely positioned surface 38. The column connecting portion 28 is also provided with a plurality of through holes 40 which are linearly arranged in two substantially straight and substantially parallel rows. Each row of through holes 40 in the column connecting portion 28 can be aligned with one of the rows of through holes in the beam connecting portion 26, although this is not necessary.

The beam connecting portion 26 and the column connecting portion 28 together define an L-shaped bracket. The L-shaped bracket is provided with an outer corner edge 42 which is adapted to fit in the interior corner formed between the column and the flange. In this way, the outer surface 36 of the column connecting element 28 can be positioned in direct abutting relation with the outwardly facing surface of the column flange while the outer surface 32 of the beam connecting element 26 is positioned in direct abutting relation with the outwardly facing surface of the beam flange.

When the bracket 20 is used for retrofitting or repairing a damaged weld connection between a beam and column in an existing steel frame structure, a back-up bar is oftentimes present on the existing construction as a result of the original welded construction. In these situations, the outer surface 32 of the beam connecting portion 26 can be provided with a notch 44 that is adapted to receive the back-up bar. In this way, the back-up bar does not interfere with the connection of the L-shaped bracket 20 to the beam flange and column flange.

The bracket 20 also includes a reinforcing element or rib 46. This reinforcing rib 46 extends from substantially the free end of the beam connecting portion 26 to the point of intersection between the column connecting portion 28 and the beam connecting portion 26. In addition, the reinforcing rib 46 extends from substantially the free end of the column connecting portion 28 to the intersection edge 48 where the inner surface 38 of the column connecting portion 28 meets the inner surface 34 of the beam connecting portion 26. Thus, the reinforcing element 46 extends for substantially the entire length of both the beam connecting portion 26 and the column connecting portion 28.

Since the through holes 40 in the column connecting portion 28 are positioned vertically above the through holes 30 in the beam connecting element 26, the tension bolts received in the through holes 40 are offset from the shear transfer bolts that are received in the through holes 30 and this causes vertical eccentricity in loading. The bending in the bracket which would otherwise normally occur as a result of this loading eccentricity is resisted by the reinforcing rib 46.

The embodiment of the bracket 20 shown in FIG. 1 is die cast in one piece. This die casting is quite advantageous as it significantly reduces the cost associated with fabricating the bracket. That is due at least to the fact that thinner material can be utilized and no welding is required. In addition, die casting the bracket provides a more cost effective approach to utilizing higher strength materials.

In this die cast embodiment of the invention, the column connecting portion 28 is provided with a generally rounded configuration at its upper free end. This rounded configuration results from the removal of structurally unnecessary portions (i.e., corners) of the column connecting portion 28, thus making for a lighter and less expensive bracket. In addition, the shape of the reinforcing element 46 is somewhat curvilinear along the surface extending from the beam connecting element to the column connecting element. However, the reinforcing rib could be similar in configuration to that shown in FIG. 2 which is described below in more detail. Further, the sides of the beam connecting portion 26 taper towards the free end of the beam connecting portion 26 because not as much strength is required at the free end of the beam connecting portion 26.

The brass plate 22 forming part of the fitting shown in FIG. 1 is adapted to be positioned between the outwardly facing surface of the beam flange and the beam flange facing surface 32 of the beam connecting portion 26. The brass plate 22 possesses a configuration that generally corresponds to the shape of the beam connecting portion 26. Thus, in the embodiment of the invention shown in FIG. 1, the brass plate is generally trapezoidal in configuration. The brass plate 22, which is much thinner than the beam connecting portion 26, includes two rows of through holes 50. The holes 50 in the brass plate 22 are adapted to be aligned with the holes 30 in the beam connecting portion 26 when the bracket 20 and the brass plate 22 are placed on the beam flange. Thus, the holes in the brass plate correspond in location to those in the beam connecting portion 26.

The brass plate 22 serves several important functions. First, the brass plate reduces the noise that occurs during slippage or other movement between the beam flange and the beam connecting portion 26. As described in more detail below, the preferred manner of effecting the bolted connection between the bracket 20 and the beam is by way of bearing bolts rather than friction bolts. Slippage typically arises between the beam connecting portion 26 and the beam flange, and this slippage or other movement would normally cause significant noise. However, the brass plate 22 substantially eliminates or reduces this noise to a large extent.

Another function served by the brass plate 22 is to smooth out slippage between the beam connecting portion 26 of the bracket 20 and the beam flange. In the absence of a brass plate, the beam flange and the beam connecting portion 26 of the bracket would tend to exhibit a series of jerking movements as a result of the two elements undergoing a series of sticking and slipping sequences. The brass plate 22, by virtue of its smooth surface characteristics, functions to reduce or substantially eliminate this sticking/slipping phenomena to thereby smooth out slippage between the beam flange and the beam connecting portion 26. On the other hand, the brass plate maintains the appropriate amount of slip resistance so that during frequently occurring minor earthquakes, slippage doesn't occur. Thus, the original configuration of the building is maintained.

A further advantageous function served by the brass plate 22 involves the ability of the plate 22 to reduce or eliminate the tendency of the holes in the beam connecting portion 26 and the holes in the beam flange to gouge one another during slippage. As can be appreciated, when the bolted connection is effected between the beam connecting portion 26 and the beam flange, a significant pressure is generated between the mating surfaces of the beam flange and the beam connecting portion 26. This is particularly so in the context of the present invention since the bolts are pretensioned. This significant pressure at the interface of the two surfaces would typically cause the holes in the two surfaces to gouge one another when slipping occurs. However, by providing the brass plate 22, this gouging affect is eliminated.

Each of the washer plates 24 is provided with a linear arrangement of through holes 52. The holes 52 in each of the washer plates 24 are adapted to be aligned with one of the rows of holes 50 in the brass plate 22 as well as one of the rows of holes in the beam connecting portion 26 of the bracket 20. The extended washer plates 24 are adapted to smooth out the clamping force between bolts to avoid force concentration at a particular area and help prevent deformation of the beam connecting portion 26. Each of the bolts that is used to connect the beam connecting portion 26 to the beam flange is torqued to a relatively high pretension force. In the absence of the washer plates 24, this force would normally be concentrated at the holes, thereby raising the possibility of deformation in the beam connecting element 26. By providing the extended washer plates 24, these normally localized forces are spread out so as not to be concentrated in one particular place.

The extended washer plates 24 also help prevent net area fracture at the bolts. That is, the extended washer plates 24 help maintain the beam flange in a relatively straight or flat manner so that if buckling in the beam flange occurs, the buckling doesn't creep into the bolted connection joint and tear the hole in the beam flange.

Figure 2:
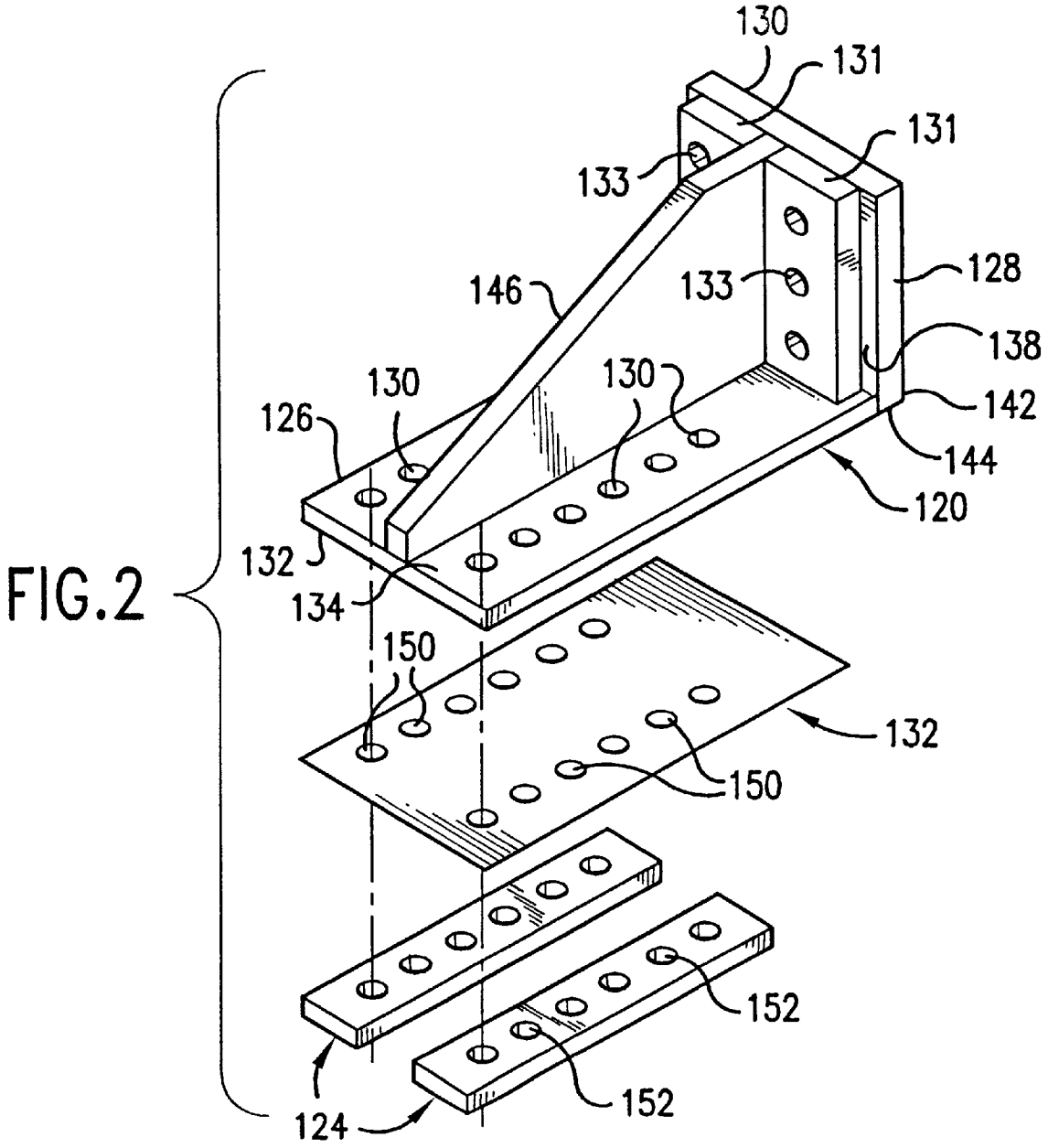
FIG. 2 is an exploded view of a fitting in accordance with another embodiment of the present invention.

As described above, the embodiment of the bracket 20 illustrated in FIG. 1 is adapted to be die cast in one piece. It is envisioned, however, that the bracket could also be fabricated by welding together the various parts making up the bracket 20. This fabricated form of the bracket is illustrated in FIG. 2. The various parts of the bracket shown in FIG. 2 which correspond to the parts in the bracket shown in FIG. 1 are designated by like reference numerals except for the numerical prefix "1". Except as described below, the features in the FIG. 2 embodiment of the bracket are the same as those described above with respect to the FIG. 1 embodiment of the bracket.

As shown in FIG. 2, the bracket 120 includes a beam connecting portion or element 126 and a column connecting portion or element 128 which together form the L-shaped bracket 120. Instead of the one piece column connecting element 28 shown in FIG. 1, the fabricated version of the bracket shown in FIG. 2 includes a pair of face plates 131 positioned on opposite sides of the reinforcing rib 146. The face plates 131 help eliminate deformation of the column connecting portion 128 which otherwise would lead to permanent damage of the column connecting portion 128 and/or the tension bolts connecting the column connecting portion to the column flange. The face plates 131 are typically used with larger beam sizes.

The face plates 131 each include a linear arrangement of through holes 133 that are adapted to be aligned with one of the linear rows of through holes in the column connecting portion 128. The face plates 131 are preferably positioned in abutting relation to the reinforcing rib 146, the beam connecting portion 126 and the column connecting portion 128. The face plates 131 can be fixed in place by welding the face plates 131 to the reinforcing rib 146, the column connecting portion 128 and the beam connecting portion 126.

In the fabricated version of the bracket shown in FIG. 2, it can also be seen that the reinforcing rib 146 possesses a linearly sloping face that is angled at approximately 30° to the plane of the beam connection portion 126. From a structural standpoint, forces in the rib increase in regions closer to the column, due to accumulated forces transferred from shear bolts and beam connecting element 126. Thus, a larger cross-sectional area is needed near the column face, as well as the beam face. On the other hand, the reinforcing rib should preferably not be so large as to adversely affect the architectural aspects of the building. The disclosed configuration for the rib addresses both of these concerns.

As in the case of the die cast version of the bracket shown in FIG. 1, the reinforcing rib 146 extends up to the free end of both the beam connection portion 126 and the column connecting portion 128. Thus, the reinforcing rib is flush with or substantially flush with the free end surface of the column connection portion 128 as well as with the free end surface of the beam connecting portion 126.

The beam connecting portion 126 is illustrated to have a width that does not taper, but it is understood that a taper similar to that shown in FIG. 1. Also, the brass plate 122 is designed to have a shape which corresponds to and matches the shape of the beam connecting portion 126.

The bracket according to the present invention provides particular advantages in connection with existing steel frame structures to repair cracked or otherwise damaged welds at the beam/column junction. The bracket according to the present invention is particularly useful in this regard because the bracket 20, 120 can be placed at the beam/column intersection and bolted in place. In existing structures in which the beam and column are welded to one another, the beam is positioned in abutting relation to the surface of the column flange. The bracket according to the present invention can be positioned at the beam/column interface so as not to require any modification to the damaged existing welded connection. Thus, if the welded connection between the beam and column is cracked or otherwise damaged, the bracket 20, 120 can simply be positioned at the beam/column interface and subsequently bolted to the beam flange and the column flange once the appropriate holes have been formed in the beam flange and column flange. In a similar manner, the bracket can be used to reinforce an existing weld connection that may not otherwise be damaged, but which nevertheless requires reinforcement or strengthening.

Figure 3:
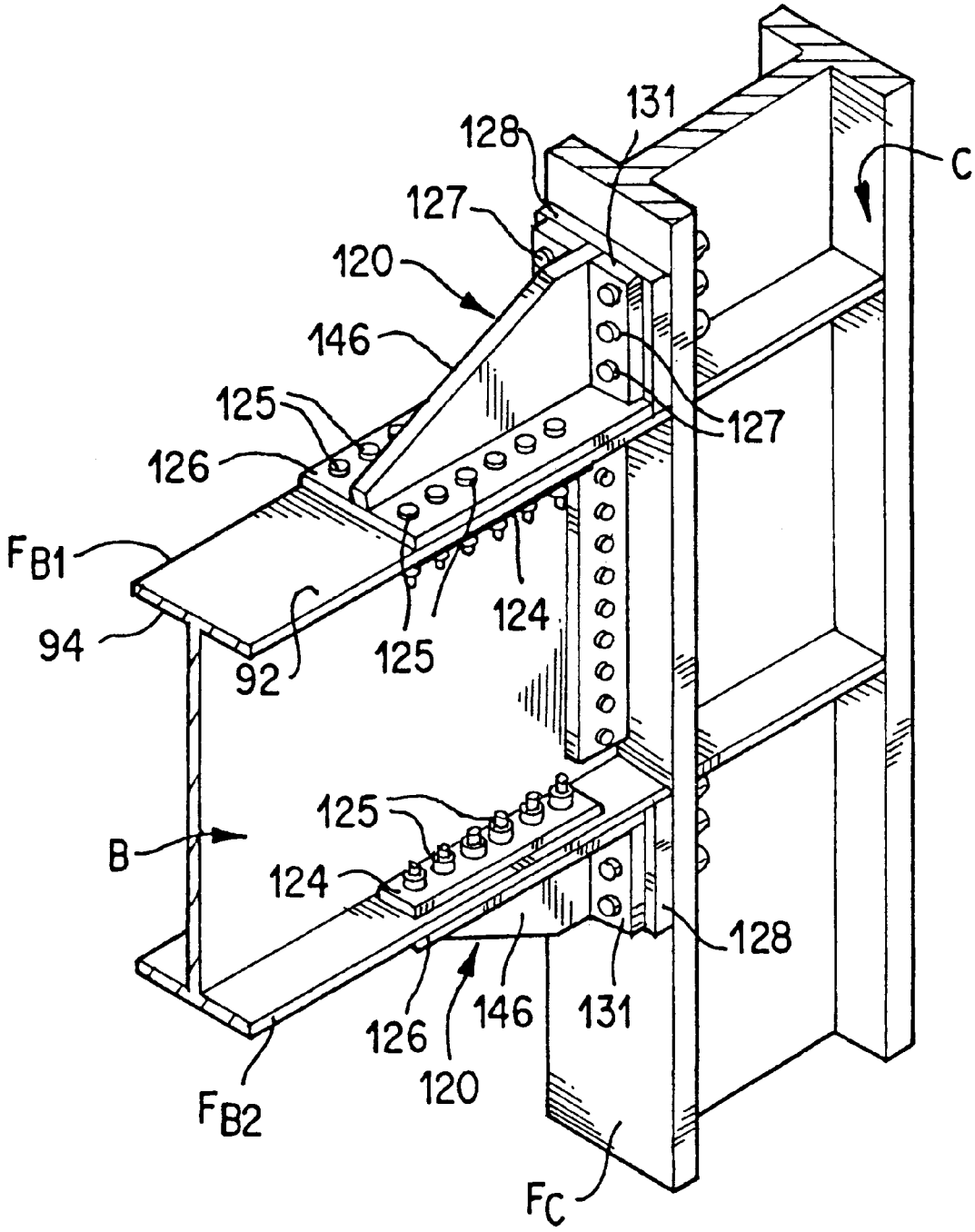
FIG. 3 is a perspective view of a portion of a beam/column connection illustrating the fitting shown in FIG. 2 bolted to a column and a beam.
Figure 4:
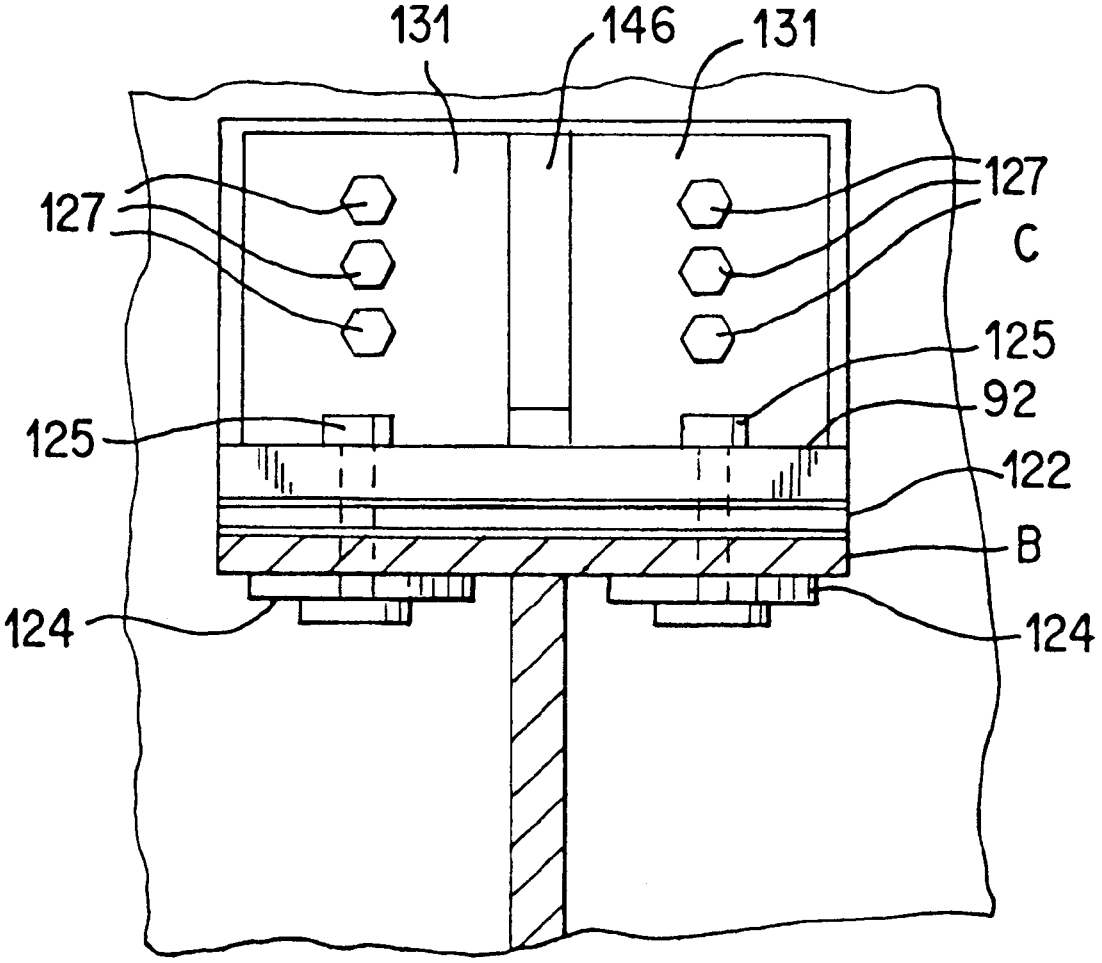
FIG. 4 is a cross-sectional view through a beam illustrating the fitting shown in FIG. 1 attached to a beam and column.

FIGS. 3 and 4 depict the fabricated bracket 120 bolted to the upper flange of a beam B and the facing flange of the column C. In retrofitting or repairing a damaged beam/column welded connection, or for simply strengthening an existing weld that may not actually be damaged, holes are formed in the flange $F_c$ of the column C corresponding to the locations of the holes in the column connecting portion 128 of the bracket 120 and the locations of the holes in the face plates 131. Similarly, holes are formed in the flange $F_{B1}$ of the beam B corresponding to the holes in the beam connecting portion 126. For purposes of avoiding excessive detail, the brass plate 122 shown in FIG. 2 is not illustrated in FIG. 3. However, as shown in FIG. 4, it can be seen that the brass plate 122 is adapted to be positioned between the beam connecting element 126 and the outwardly facing surface 92 of the flange $F_{B1}$ of the beam B to which the beam connecting element 126 is bolted.

In addition, the extended washer plates 124 are positioned on the inwardly facing surface 121 of the flange $F_{B1}$ of the beam B so that the holes in the extended washer plates 124 are aligned with the holes in the beam connecting portion 126 and the holes in the brass plate 122. Bolts 125 can then be positioned in the aligned holes of the beam connecting portion 126, the brass plate 122, the flange $F_{B1}$ of the beam B and the extended washer plates 124, with a nut being threaded to the bolt on the inner side of the beam flange $F_{B1}$. Similarly, bolts 127 are positioned through the aligned holes in the face plates 131, the column connecting portion 128 and the flange $F_c$ of the column C, with a nut being threaded to the end of the bolt on the inner side of the column flange $F_c$. It is of course to be understood that the bolts could be threaded through the aligned holes from the inner side of the beam flange and column flange so that the nut is located on the opposite side of the flanges shown in FIG. 4. It is also envisioned that if the column flange $F_c$ is relatively thin, an extended washer plate can also be positioned on the inwardly facing surface of the column flange $F_c$ in much the same way as the extended washer plates 124 are used on the inwardly facing surface of the beam flange $F_c$.

As can also be seen in FIG. 3, a second bracket 120 is provided to effect a bolted connection between the flange $F_c$ of the column C and the other flange $FB_{B2}$ on the beam B. The connection is the same as that described above.

It is to be understood that the die cast bracket 20 illustrated in FIG. 1 would likewise be connected to the beam B and column C of the steel frame structure in much the same way as that illustrated in FIGS. 3 and 4.

Figure 5:
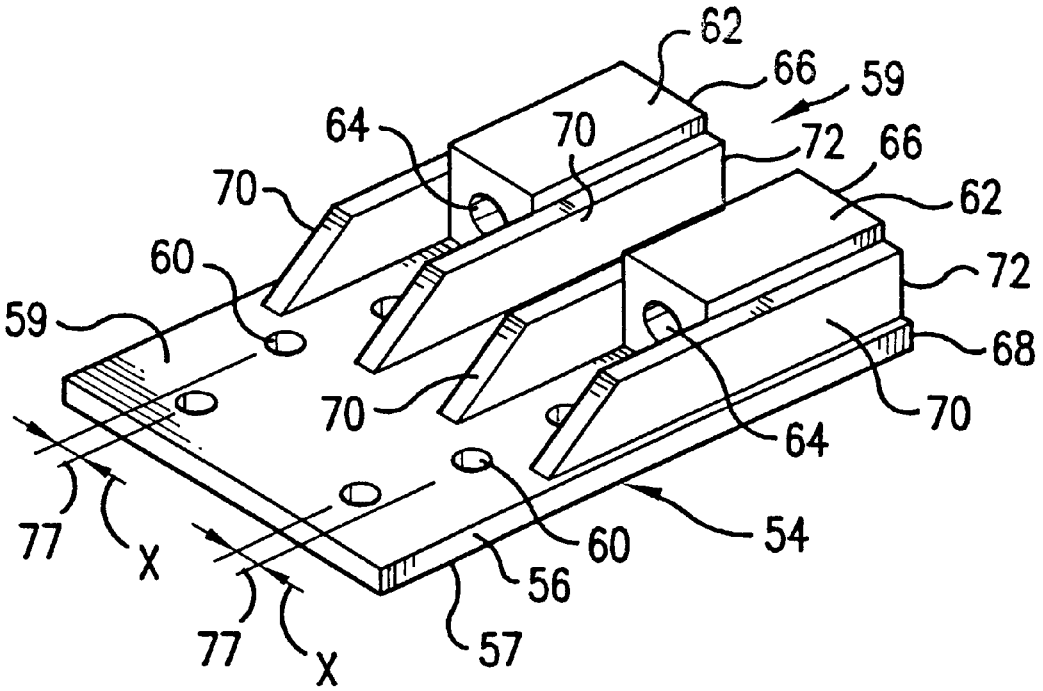
FIG. 5 is a perspective view of an outer flange surface bracket according to another embodiment of the present invention for attachment to the outwardly facing flange surfaces at the top and bottom of the beam.

FIG. 5 illustrates an alternative form of a fabricated bracket in accordance with the present invention in which the various parts of the bracket are welded to one another. As seen in FIG. 5, the bracket is in the form of an outer flange surface bracket 54 that includes a beam connecting element or portion 56 and a column connecting element or portion 58. The beam connecting element 56 is provided with an outwardly facing surface 57 that is adapted to face the flange of the beam and an oppositely positioned inwardly facing surface 59. The beam connecting portion 56 consists of a generally flat planar plate provided with a plurality of through holes 60. The through holes 60 can be aligned in two generally straight rows 77 that are parallel to one another, with the hole in each row located farthest from the column connecting element being offset inwardly with respect to the other holes in the row by a distance X. This offset of the forwardmost holes 60 helps avoid net section failure by locating the holes closer to the beam web where the web tends to reinforce the beam flange.

The beam connecting element 56 includes two spaced apart pipe elements 62, each of which is provided with a single longitudinally extending through hole 64. As can be seen, the longitudinally extending through hole 64 can be aligned with the line 77 along which lies the sets of through holes 60 in the beam connecting element 56, although this is not necessary. In this fabricated version of the bracket 54, the rear surface 66 of each pipe element 62 is aligned with the end surface 68 of the beam connecting element 56. This then allows the beam connecting element 56 and the pipe elements 62 to be placed flush against and in abutting relation to the flange of the column.

The bracket shown in FIG. 5 also includes two pairs of reinforcing elements 70. One pair of reinforcing elements 70 is disposed on opposite sides of one of the pipe elements 62 while the other pair of reinforcing elements 70 is positioned on opposite sides of the other pipe element 62. The forward extending edges of each of the reinforcing ribs 70 is provided with an inclined face that is angled at approximately 45 degrees. This inclination of the forward facing end of the ribs 70 makes it easier to tighten the bolts.

Each pair of reinforcing ribs 70 is positioned so that one row of holes 60 extends generally along a line disposed between each pair of reinforcing ribs 70. More specifically, each row of holes 60 is located between the planes in which lie the two reinforcing ribs 70 defining one of the pairs of reinforcing ribs.

The rear surface 72 of each reinforcing element 70 is aligned with both the end surface 68 of the beam connecting element 56 and the rear surface 66 of the pipe elements 62. Thus, when the bracket 54 is mounted at the intersecting joint of a beam and column, the end surface 68 of the beam connecting element 56, the rear surface 66 of the pipe elements 62 and the end surface 72 of the reinforcing ribs 70 all abut against the flange of the column.

The reinforcing ribs 70 are quite important as they tend to resist bending that occurs as a result of vertical eccentricity and loading. This vertical eccentricity and loading is caused by the offset between the axis of the tension bolt in the pipe elements 62 and the plane of the beam connecting element 56 through which extend the other connecting bolts. This vertical eccentricity tends to cause bending at the intersection between the beam connecting element 56 and the column connecting element 58, but the presence of the reinforcing ribs 70 tends to resist such bending.

In the fabricated construction of the bracket shown in FIG. 5, the pipe elements 62 are welded to the underlying beam connecting element 56 along weld lines extending along the sides of the pipe elements 62. Likewise, the reinforcing ribs 70 are welded to the beam connecting element 56 along weld lines extending along the sides of the reinforcing ribs 70.

The bracket 54 illustrated in FIG. 5 is designed so that the beam connecting element 56 is mounted on and secured to the outwardly facing surface of each flange of the beam. It is envisioned that situations may arise, depending upon the size of the beam and column and the particular loading conditions, in which it will be necessary to also provide a connecting bracket on the inwardly facing surface of each flange of the beam. In such situations, the fitting can include an inner flange surface bracket 78 such as that illustrated in FIG. 6. As seen with reference to FIG. 6, the bracket 78 is identical to one-half of the bracket 54 shown in FIG. 5.

Figure 6:
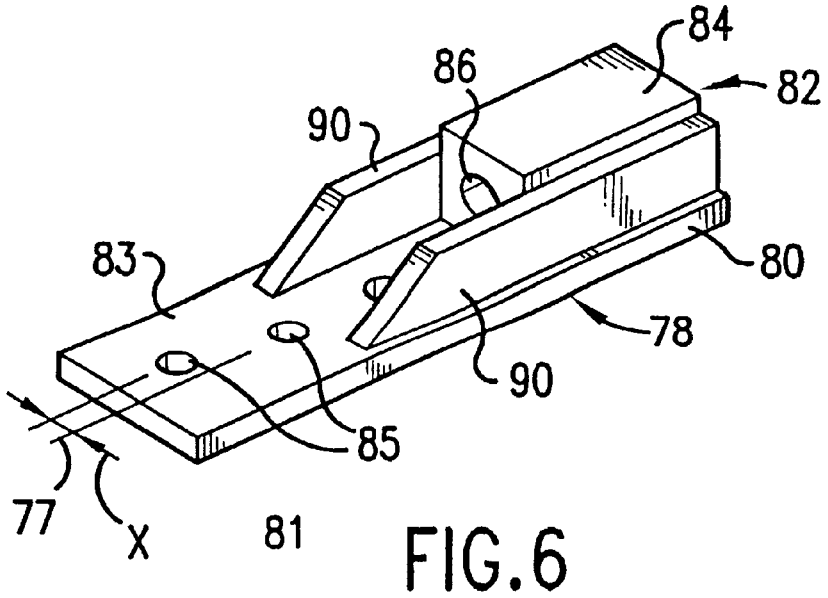
FIG. 6 is a perspective view of an inner flange surface bracket usable in conjunction with the bracket shown in FIG. 5 for attachment to the inwardly facing flange surfaces of the beam.

The half-bracket 78 shown in FIG. 6 includes a beam connecting element 80 in the form of a plate and a column connecting element or portion 82 in the form of a pipe element 84. The beam connecting element or portion 80 is provided with a beam flange facing surface 81 that is adapted to face the beam flange and an oppositely positioned surface 83. The pipe element 84 is provided with a single through hole 86 that is aligned with a linear arrangement of through holes 88 in the beam connecting element 80. The forwardmost hole 85 in the beam connecting element 80 can be offset by a distance x with respect to the line 77 along which are disposed the other holes 85. A pair of reinforcing ribs 90 is positioned on opposite sides of the pipe element 84 and are welded to the beam connecting element 80. Similarly, the pipe element 84 is welded to the beam connecting portion 80. In all other respects, the bracket illustrated in FIG. 6 is identical to one-half of the bracket illustrated in FIG. 5.

Figure 13:
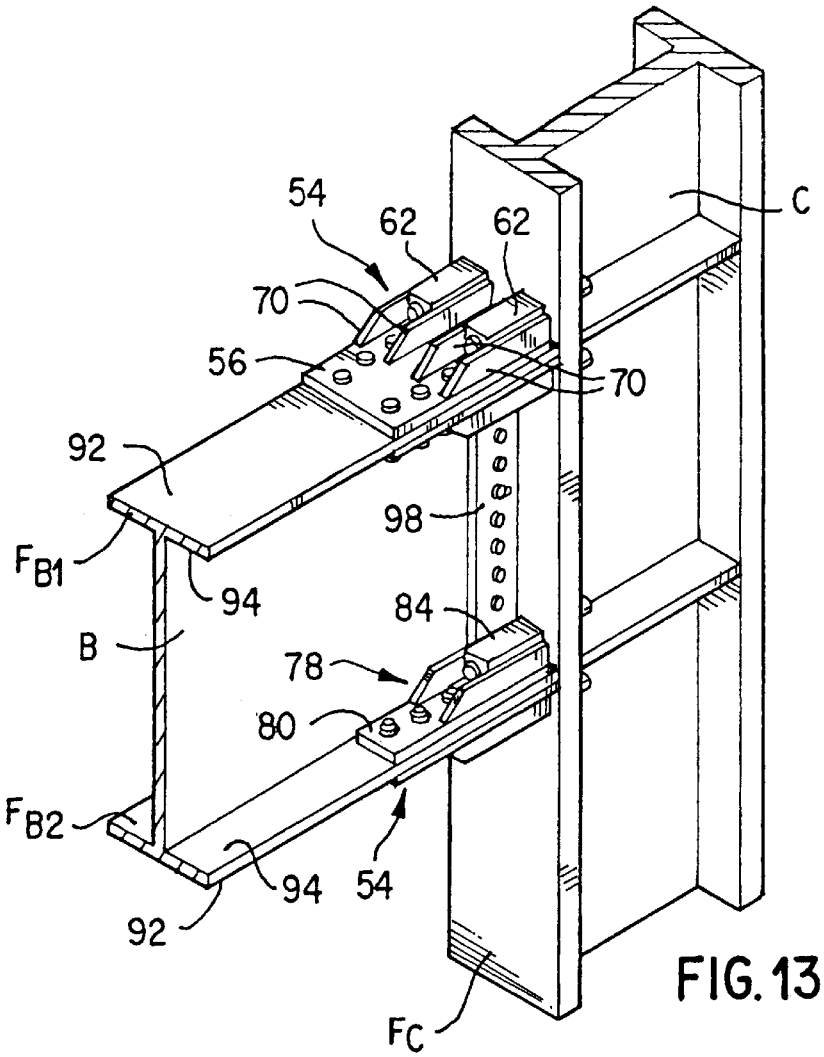
FIG. 13 is a perspective view of a portion of a beam/column connection illustrating the brackets shown in FIGS. 5 and 6 bolted to a column and a beam.
Figure 14:
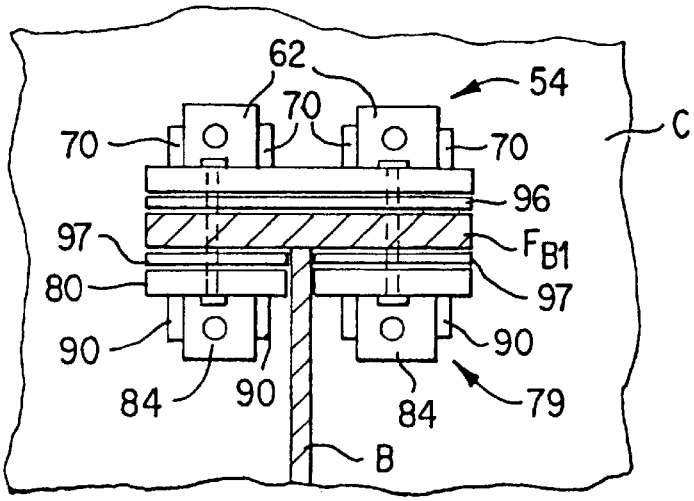
FIG. 14 is a cross-sectional view through a beam illustrating the brackets shown in FIGS. 5 and 6 connected to a beam and column.

FIGS. 13 and 14 illustrate the way in which the outer flange surface brackets 54 are mounted on and bolted to a beam B and a column C. As can be seen, a beam connecting element 56 is positioned in abutting relation to the outwardly facing surface 92 on each of the flanges $F_{B1}$ and $F_{B2}$ of the beam B. In addition, a pair of inner flange surface brackets 78 is mounted on the inwardly facing surface 94 of each of the flanges $F_{B1}$, $F_{B2}$ of the beam B. Thus, each flange $F_{B1}$, $F_{B2}$ of the beam B has secured thereto one of the full-brackets 54 illustrated in FIG. 5 and a pair of the half-brackets 78 illustrated in FIG. 6.

The brackets 54, 78 are positioned so that each linear arrangement of through holes 60 in the beam connecting element 56 of the full-bracket 54 is aligned with the set of through holes 85 in the beam connecting element 80 of one of the underlying half-brackets 78. Further, as seen with reference to FIG. 14, a brass plate 96 similar to the brass plates 22 illustrated in FIGS. 1 and 2 is disposed between the full-bracket 54 and the outwardly facing surface 92 of each beam flange $F_{B1}$, $F_{B2}$. The brass plate 96 includes a series of through holes that are adapted to be aligned with the through holes 60 in the full-bracket 54 as well as the through holes 85 in the half-brackets 78.

When the brackets 54, 78 illustrated in FIGS. 5 and 6 are used to repair a damaged weld joint at a beam/column intersection, a hole is drilled in the flange $F_c$ of the column C corresponding to each of the through holes 64 in the pipe elements 62 of the full-bracket 54. Likewise, a hole is drilled in the flange $F_c$ of the column C corresponding to the through hole 86 in the pipe element 84 of each half-bracket 78. Respective bolts are then inserted through the through holes 64, 86 of the pipe elements 62, 84 and through the aligned holes in the flange $F_c$ of the column C. A nut is then provided to threadably engage the bolt and complete the bolted connection. In addition, through holes are formed in both of the flanges $F_{B1}$, $F_{B2}$ of the beam B to correspond to the holes 60 in the beam connecting element 56 of the full-bracket 54 as well as the holes in the brass plate 96 and the holes 85 in the beam connecting element 80 of the half-brackets 78. Bolts are then placed through the aligned holes and a corresponding nut is placed on the bolt. Of course, the bolts can be oriented in a direction opposite to that illustrated in FIG. 14 so that the nuts are positioned on the outwardly facing surfaces of the beam flanges $F_{B1}$, $F_{B2}$. Also, as seen in FIG. 14, a brass plate 97 is advantageously positioned between each of the half-brackets 78 and the inner surface of the beam flange.

As can be seen in FIG. 13, a typical beam/column welded connection includes a shear plate 98 which is bolted to the beam web. To the extent the bolts which connect this shear plate 98 to the web of the beam B might interfere with the reinforcing ribs 90 on the half-brackets 78, it might be necessary to shorten the height of the reinforcing ribs 90 located closest to the web of the beam B.

Figure 7:
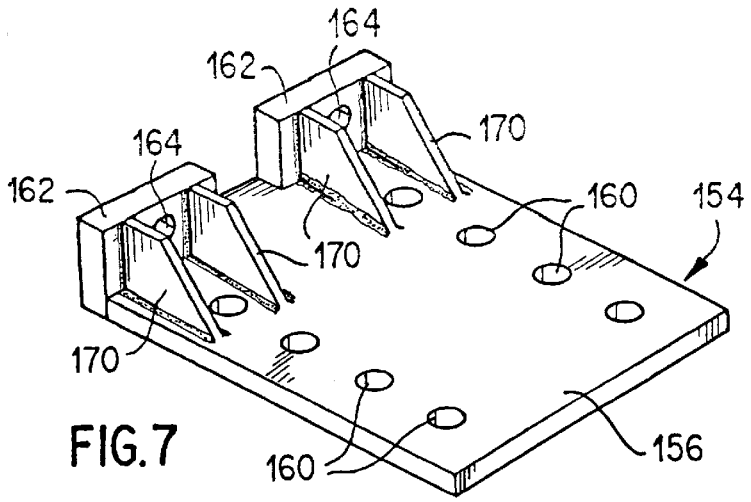
FIG. 7 is a perspective view of another embodiment of an outer flange surface bracket according to the present invention for attachment to the outwardly facing flange surfaces of the beam.
Figure 8:
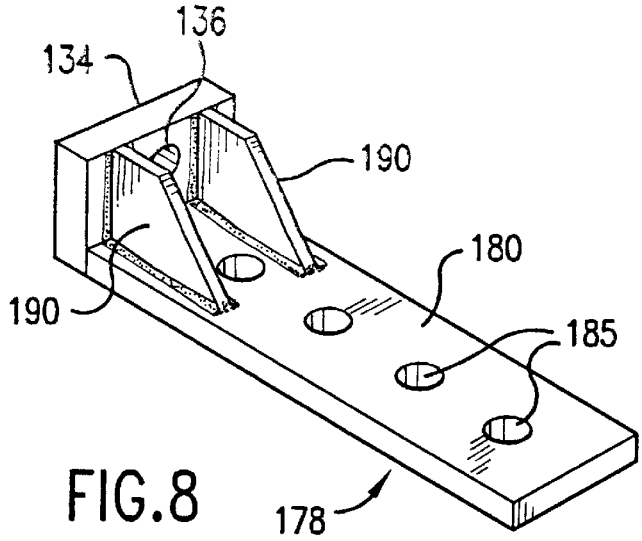
FIG. 8 is a perspective view of an inner flange surface bracket usable in conjunction with the bracket shown in FIG. 7 for attachment to the inwardly facing flange surfaces of the beam.

FIG. 7 illustrates an alternative embodiment of the outer flange surface bracket while FIG. 8 illustrates the corresponding inner flange surface bracket used in connection with the full-bracket shown in FIG. 7. The full-bracket shown in FIG. 7 and the half-bracket shown in FIG. 8 are similar in many respects to the full-bracket shown in FIG. 5 and the half-bracket shown in FIG. 6 respectively, and so parts of the full-bracket and half-bracket shown in FIGS. 7 and 8 which correspond to parts illustrated in FIGS. 5 and 6 are provided with corresponding reference numerals except for the prefix "1".

Like the full-bracket and half-bracket shown in FIGS. 5 and 6, the full-bracket 154 shown in the FIG. 7 and the half-bracket shown in FIG. 8 are intended to be fabricated by welding together various parts. As shown in FIG. 7, the pipe elements 162 have a smaller longitudinal extent than the pipe elements shown in the embodiment of FIG. 5. In addition, the reinforcing ribs 170 extend from the front face of the pipe elements 162 rather than along the sides of the pipe elements. Likewise, in the case of the half-bracket 178 shown in FIG. 8, the pipe element 184 possesses a smaller longitudinal extent than the pipe element 84 shown in FIG. 6 and the reinforcing ribs 190 extend from the front face of the pipe element 184 rather than being disposed along the outer sides of the pipe element.

In the bracket 154 shown in FIG. 7, each of the pipe elements 162 is aligned with one of the longitudinally extending edges of the beam connecting element 156. In the case of the corresponding half-bracket shown in FIG. 8, the pipe element 184 possesses a width that substantially corresponds to the width of the beam connecting element 180. The full-bracket 154 shown in FIG.7 and the half-bracket 178 shown in FIG. 8 are better suited for supporting lighter loads and can be fabricated from less material than the full-bracket and half-bracket versions shown in FIGS. 5 and 6.

The full-bracket 154 and half-bracket 178 illustrated in FIGS. 7 and 8 are adapted to be connected to a beam and column in the same way as that described above and illustrated with reference to FIGS. 13 and 14.

Figure 9:
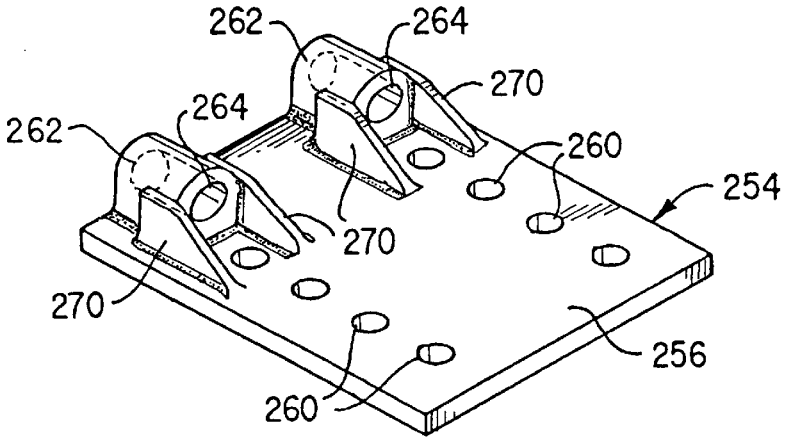
FIG. 9 is a perspective view of another embodiment of the outer flange surface bracket according to the present invention for attachment to the outwardly facing flange surfaces of the beam.
Figure 10:
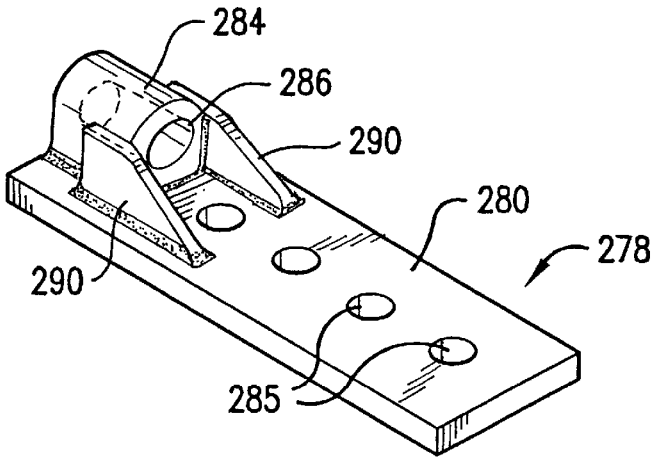
FIG. 10 is a perspective view of an inner flange surface bracket usable in conjunction with the bracket shown in FIG. 9 for attachment to the interior surface of the beam flange.

FIGS. 9 and 10 illustrate another alternative to the full-bracket and half-bracket shown in FIGS. 5 and 7. The features of the full-bracket shown in FIG. 9 and the half-bracket shown in FIG. 10 which correspond to the features of the full-bracket shown in FIG. 5 and the half-bracket shown in FIG. 6 are provided with corresponding reference numerals except for the prefix "2".

The embodiment of the bracket 254 shown in FIG. 9 and the half-bracket 278 illustrated in FIGS. 9 and 10 differ from the embodiment of the bracket 54 shown in FIG. 5 and the embodiment of the half-bracket shown in FIG. 6 in that the embodiment of the full-bracket 254 and half-bracket 278 illustrated in FIGS. 9 and 10 are adapted to be die cast in one piece rather than fabricated from welded parts. This method of production is highly advantageous in that it greatly reduces the cost of manufacturing the bracket by as much as 50% with respect to the fabricated bracket.

As can be seen from FIG. 9, the die cast version of the full-bracket 254 includes a beam connecting element 256 in the form of a plate and two pipe elements 262 which constitute the column connecting element. Each of the pipe elements 262 possesses a rounded exterior configuration and is provided with a single through hole 264 for effecting the bolted connection with the column flange. Positioned on each side of each of the pipe elements 262 is a pair of reinforcing ribs 270. The beam connecting element 256 in the form of a plate is provided with a plurality of through holes 260 for effecting the bolted connection to the flanges of the beam. The through holes 260 are aligned in two linear rows. The through hole 264 in each pipe element 262 can be aligned with one of the rows of through holes 260 in the beam connecting element 256. As is the case with the full-bracket shown in FIGS. 5 and 7, the full-bracket is symmetrical about a line which extends the length of the column connecting member 256 and which extends midway between the pipe elements 262.

In the case of the half-bracket 278 shown in FIG. 10, the beam connecting element 280 is provided with a plurality of through holes 285 arranged along a single line. The column connecting portion of the bracket 278 is in the form of a pipe element 284 that is provided with a through hole 286. The longitudinal axis of the through hole 286 is aligned with the row of through holes 285 provided in the beam connecting element 280. The features of the half-bracket 278 shown in FIG. 9 are the same as those associated with one-half the full-bracket 254 shown in FIG. 9. The bracket 254 and half-bracket 278 illustrated in FIGS. 9 and 10 are adapted to be connected to a beam and column in the same way as that described above and illustrated with reference to FIGS. 13 and 14.

Figure 11:
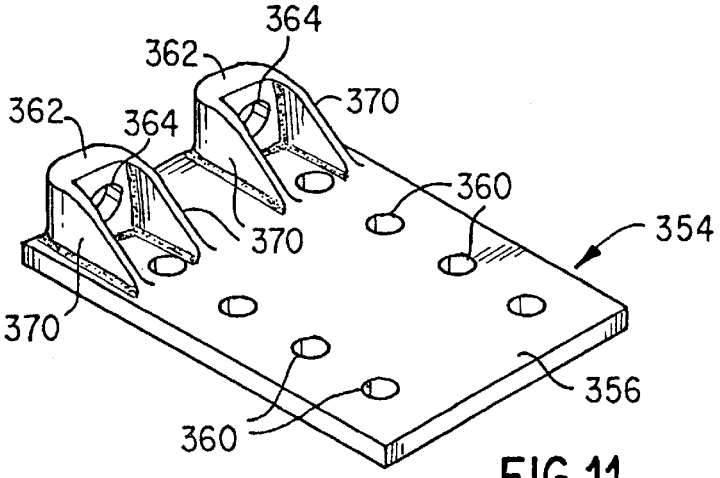
FIG. 11 is a perspective view of another embodiment of the outer flange surface bracket according to the present invention for attachment to the outwardly facing flange surfaces of the beam.
Figure 12:
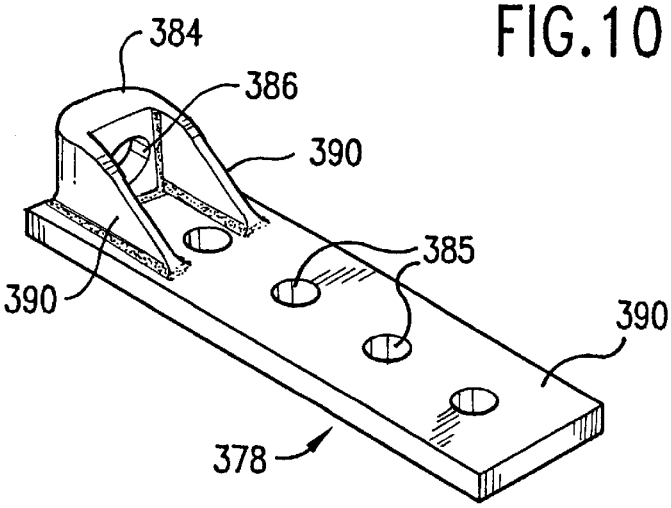
FIG. 12 is a perspective view of an inner flange surface bracket usable in conjunction with the bracket shown in FIG. 11 for attachment to the interior surface of the beam flange.

FIGS. 11 and 12 illustrate a further embodiment of the full-bracket and half-bracket in which the brackets are die cast. Once again, the portions of the full-bracket shown in FIG. 11 and the half-bracket shown in FIG. 12 which correspond to features of the full-bracket and half-bracket shown in FIGS. 5 and 6 are designated with corresponding reference numerals except for the prefix "3".

As can be seen with reference to FIG. 11, the beam connecting element 356 of the full-bracket 354 is in the form of a plate having two spaced apart rows of through holes 360 for alignment with holes in the beam flange to effect the bolted connection. The column connecting portion of the bracket 354 is in the form of a pair of spaced apart pipe elements 362. Extending from the front face of each of the pipe elements 362 is a pair of reinforcing ribs 370. Each of the pipe elements 362 is provided with a single through hole 364 whose longitudinal axis may be aligned with one of the rows of through holes 360 in the beam connecting portion 356.

In the corresponding version of the half-bracket 378 shown in FIG. 12, the beam connecting element 380 is in the form of a plate while the column connecting portion is in the form of a pipe element 384. The pipe element 384 is provided with a single through hole 386 that is aligned with the row of through holes 385 in the beam connecting portion 380. Extending from the front face of the pipe element 384 is a pair of reinforcing ribs 390 which are disposed at equal distances from the line along which are arranged the through holes 385 in the beam connecting element 380.

In each of the embodiments of the invention described above, it is preferred that a bearing bolt connection be utilized between the bracket and the flanges of the beam and column. This bearing bolt connection involves the use of bolts whose outer diameter is only slightly smaller than the diameter of the holes through which the bolts extend (i.e., approximately 1/32nd of an inch smaller). In this way, a more rigid connection is more provided. By utilizing this type of bearing bolt connection, it is possible to reduce the number of bolts by up to one third as compared to, for example, the use of a friction bolt connection.

It is to be understood that in all versions of the brackets described above, a notch can be provided on the outer surface of the beam connecting portion similar to the notch 44 shown in FIG. 1 for purposes of receiving the back-up bar that is typically found on existing welded structures. Additionally, the embodiments of the brackets shown in FIGS. 1, 2, 7, 9 and 11 can each be designed so that the forwardmost holes in the beam connecting portion are offset towards one another as shown in FIG. 5 and described above. Similarly, the embodiments of the brackets shown in FIGS. 8, 10 and 12 can be configured so that the forwardmost hole in the beam connecting portion is offset in a manner similar to that shown in FIG. 6.

As can be appreciated from consideration of the foregoing description, the present invention provides a fitting for effecting a bolted connection between a beam and a column that is particularly well suited for repairing or retrofitting damaged weld connections between a beam and a column in an existing steel frame structure. As a result of this invention, it is not necessary to perform extensive modification to the damaged joint (e.g., torching the damaged weld) in order to secure the fitting in place. Rather, it is typically only necessary to form holes in the beam flange and column flanges and then secure the fitting in place on the beam and column through the use of bolts.

The present invention offers significant advantages over the typical rewelding that is utilized to repair damaged weld connections. In one respect, the danger of fire presented by rewelding is eliminated. The fitting of the present invention also provides a much better range of structural performance (e.g., as much as 100% more plastic rotational capacity) than welded connections. The bolted connection fitting also allows for a much faster installation time, thereby presenting less of a disturbance to tenants in occupied structures. Additionally, the installation cost is typically much cheaper. Further, the bolted connection fitting improves the reliability of the structure so that damage is not likely to occur in future earthquakes.

The various fittings according to the present invention can be dimensioned based on the size of the beam and the loading conditions associated with a particular steel frame structure. To provide an example of some of the dimensions associated with various parts of the fittings in a situation where the beam has a depth of approximately 35–40 inches and typical proportions of flange width and thickness and web thickness, the fitting illustrated in FIG. 2 can possess dimensions along the lines discussed below. The bracket 120 can be designed to possess an overall length parallel to the beam connecting element 121 of about 26 inches and an overall height of approximately 12 inches, with the plate defining the beam connecting element 126 being one inch in thickness and each of the column connecting element 128 and the face plates 131 being 1.5 inches in thickness. The holes in the face plates 131 and the column connecting portion 136 can be spaced apart about 3.5 inches. The width of the beam connecting element 126 can be on the order of about 12 inches, with the spacing between adjacent through holes 130 in a row being on the order of approximately 3.5 inches and the spacing between the two rows of holes being about 6.5 inches (except for the forwardmost holes). The total number of holes in the facing plates 131 and the column connecting portion 136 can be varied between six and eight while the total number of holes in the beam connecting portion 126 can be varied between 10 and 16. The bracket 120 and the extended washer plates 124 can be made of A572 Grade 50 steel while the brass washer plate 122 is made of brass UNS-260. The reinforcing rib 146 can be 1.5 inches in thickness while the brass washer plate 122 is 1/16–1/8 inch in thickness. Grade 70 steel could alternatively be utilized resulting in thinner parts.

The holes in the column connecting portion 136 and the face plates 131 can be 1 5/8 inch in diameter, thereby permitting the use of A490 bolts having a diameter of 1.5 inches. A490 bolts having a diameter of 1.125 inches can be positioned in the holes in the beam connecting portion 126, the brass washer plate 122 and the extended washer plates 124 which are approximately 1/32nd of an inch in diameter larger than the bolts With respect to the versions of the full-brackets illustrated in FIGS. 5, 7, 9 and 11, the beam connecting portion can be on the order of approximately 10 inches wide, 19 inches long and 0.75 inches thick. The reinforcing ribs can have a thickness of approximately 0.25 inches and the space between adjacent holes in a row in the beam connecting portion can be on the order of about 3.5 inches. The spacing between the two roles of through holes in the beam connecting element can be approximately five inches. The through hole in each of the pipe elements can be located such that the longitudinal axis of the through hole is positioned approximately 1.25 inches above the top surface of the beam connecting portion. The brass washer plate and the bracket can be made of material similar to those mentioned above and the brass washer plate can be approximately 1/16–1/8 inch in thickness. The hole in each of the pipe elements can be on the order of approximately 1 5/8 inches to thereby receive a 1.5 inch diameter bolt. The holes in the beam connecting portion can be on the order of about 1.25 inches in diameter to receive bolts having a diameter of 1 1/8 inches.

Insofar as the half-brackets illustrated in FIGS. 6, 8, 10 and 12, the beam connecting portion can have a width of approximately five inches and a length which corresponds to the length of the full bracket. The thickness of the beam connecting portion can be on the order of 1.25 inches.

Although the full-brackets and half-brackets illustrated in FIGS. 5–12 have been described above as being used together, depending upon the size of the beam and the loads expected to be encountered by the frame structure, it may be possible to do away with the half-brackets so that the beam is connected to the column solely by way of two full-brackets 54, 154, 254, 354. In such a situation, the half-brackets would be replaced by extended washer plates similar to those shown in FIGS. 1 and 2.

As can be seen from the foregoing, the various embodiments of the fittings according to the present invention advantageously provide a mechanism for repairing damaged welds in existing structures. It should be appreciated, however, that the present invention also has other applications. In one respect, the fittings according to the present invention can be used to upgrade welded connections between a beam and a column that might not otherwise be damaged, thereby reducing the possibility that the weld will become damaged during earthquakes or other phenomena which might otherwise cause significant damage to the steel frame structure. Also, the fittings in accordance with the present invention can be utilized in the context of building new steel frame structures. In this regard, the brackets can be bolted to the beam at the manufacturing plant, and then transported to the construction site where it is bolted to the column. Alternatively, it is envisioned that the brackets could be welded to the beam flanges and subsequently transported to the construction site for bolted connection to the column flange. In this latter situation, it is understood that the brass plate and washer plates will be unnecessary. Regarding new constructions, the present invention is particularly useful as the brackets are designed to allow the end of the beam to be placed directly against and in abutting relation to the column flange during connection. This means that the column provides support for the beam.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. Method of repairing a damaged weld connection between a beam and a column in an existing steel frame structure, comprising:

providing a bracket having a beam connecting plate and a column connecting element extending from the beam connecting plate, said beam connecting plate having an outer surface and being provided with a plurality of through holes, said column connecting element having an outer surface and being provided with at least one through hole;

forming at least one first hole in a flange of the column of the existing steel frame structure which has a damaged weld connection between the beam and the column;

forming a plurality of first holes in a flange of the beam of the existing steel frame structure which has a damaged weld connection between the beam and the column;

positioning said bracket so that the outer surface of the beam connecting element faces said flange of the beam and the outer surface of the column connecting plate faces the flange of the column;

connecting the beam connecting element to the flange of the beam of the existing steel frame structure by providing a plurality of bolted connections each extending through one of the holes in the beam connecting plate and one of the first holes in the flange of the beam; and connecting the column connecting element to the flange of the column of the existing steel frame structure by providing a bolted connection extending through the hole in the column connecting element and the first hole in the flange of the column.

2. Method according to claim 1, wherein said bracket includes an outer edge corner, said bracket being positioned so that the outer surface of the column connecting element abuts the flange of the column and the outer surface of the beam connecting element abuts the flange of the beam.

3. Method according to claim 1, wherein said bracket is a first bracket, and the method further comprises: providing a second bracket separate from the first bracket, said second bracket having a column connecting element provided with at least two through holes and a beam connecting element provided with a plurality of through holes, forming at least two second holes in the flange of the column, forming a plurality of second through holes in a second flange of the beam, placing the second bracket so that the column connecting element of the second bracket faces said flange of the column and the beam connecting element faces the second flange of the beam, providing a bolted connection between the column connecting element of the second bracket and the flange of the column, and providing a bolted connection between the beam connecting element of the second bracket and the second flange of the beam.

4. Method according to claim 1, including positioning a brass plate between the beam connecting element and the flange of the beam to reduce noise during relative movement between the beam and the beam connecting element, said brass plate including a plurality of holes that are aligned with the holes in the beam connecting element.

5. Method according to claim 1, including positioning at least one washer plate on a side of said flange opposite the beam connecting element, said washer plate having a plurality of through holes that are aligned with holes in the flange of the beam and holes in the beam connecting element.

6. Method according to claim 5, including positioning a brass plate between the beam connecting element and the flange of the beam to reduce noise during relative movement between the beam and the beam connecting element.

7. Method according to claim 1, wherein said column connecting element is a vertical plate provided with a plurality of through holes and said beam connecting element is a horizontal plate, the outer surface of said vertical plate defining with the outer surface of said horizontal plate an outer corner edge, and including forming a plurality of through holes in the flange of the column, positioning the bracket so that the holes in the vertical plate are aligned with the holes in the flange of the column, providing a bolted connection between the vertical plate and the flange of the column by way of said through holes in the flange of the column and the through holes in the vertical plate.

8. Method according to claim 1, wherein said beam connecting element is a horizontal plate having an end surface and said column connecting element includes two separate and spaced apart pipe elements extending from the horizontal plate, each of said pipe elements having an end surface aligned with the end surface of the horizontal plate, each of said pipe elements having a single through hole formed therein, the method including forming two holes in the flange of the column, positioning the bracket so that the through hole in each pipe element is aligned with one of the through holes in the flange of the column, and providing a bolted connection between the pipe elements and the flange of the column by way of the through holes in said pipe elements and the through holes in the flange of the column.

9. Method of constructing a steel frame structure, comprising:

providing a first bracket having a beam connecting plate and a column connecting element extending from the beam connecting plate, said column connecting element having an outer surface and being provided with a plurality of through holes;

providing a second bracket having a beam connecting plate and a column connecting element extending from the beam connecting plate, said column connecting element of said second bracket having an outer surface and being provided with a plurality of through holes;

forming a plurality of first holes in a flange of a column;

forming a plurality of second holes in the flange of the column;

connecting said beam connecting plate of said first bracket to a first flange of a beam and connecting said beam connecting plate of said second bracket to a second flange of the beam;

placing said beam so that an end of the beam is in contact with an outwardly facing surface of the flange of the column and so that the outer surface of the column connecting element of said first bracket and the outer surface of said column connecting element of the second bracket each face the outwardly facing surface of the flange of the column; and connecting the column connecting element of said first bracket and said column connecting element of said second bracket to the flange of the column by providing a plurality of a bolted connections each extending through one of the holes in the column connecting element of said first bracket and one of the first holes in the flange of the column and a plurality of second bolted connections each extending through one of the holes in the column connecting element of said second bracket and one of the second holes in the flange of the column.

10. Method according to claim 9, wherein said beam connecting plate has an end surface and said column connecting element includes two spaced apart pipe members extending from the beam connecting plate, each of said pipe members having an end surface aligned with the end surface of the horizontal plate, each of said pipe members having a single through hole formed therein, said step of forming a plurality of first holes in the flange of the column including forming two first holes in the flange of the column, and including positioning the bracket so that the through hole in each pipe member is aligned with one of the first through holes in the flange of the column, and providing a bolted connection between each of the pipe members and the flange of the column by way of the through holes in said pipe members and the first holes in the flange of the column.

11. Method according to claim 9, including positioning a brass plate between the beam connecting plate and the flange of the beam to reduce noise during relative movement between the beam and the beam connecting element, said brass plate including a plurality of holes that are aligned with the holes in the beam connecting plate.

12. Method according to claim 10, wherein said bracket is a first bracket, and including providing a second bracket having a beam connecting plate and a pipe element connected to the beam connecting plate, said pipe element of said second bracket being provided with a single through hole, forming a second hole in said flange of said column, positioning said second bracket on an inwardly facing surface of said flange that is opposite the outwardly facing surface of said flange, connecting said beam connecting plate to the inwardly facing surface of said flange, and providing a bolted connection that extends through the hole in the pipe element and the second hole in the flange of the column to connect the pipe element to the column.

13. Fitting for connecting together a beam and a column in a steel structure, comprising a one piece L-shaped bracket that includes a horizontal beam connecting element for being connected to a beam forming a part of a steel structure, and a vertical column connecting element for being connected to a column forming a part of the steel structure, said column connecting element lying in a vertical plane, said column connecting element and said beam connecting element intersecting to define an inner corner of the bracket, said horizontal beam connecting element having an outer surface adapted to face a flange of the beam and said vertical column connecting element having an outer surface adapted to face a flange of the column, said L-shaped bracket having an outer corner edge adapted to be positioned at a corner formed between the beam and the column, said horizontal beam connecting element lying in a horizontal plane and said bracket being asymmetrical about said plane, said horizontal beam connecting element having a free end opposite from said outer corner edge, the entirety of said free end of said horizontal beam connecting element lying in said horizontal plane, said column connecting element having a plurality of through holes formed in two rows for alignment with holes in the column to provide a bolted connection between the column connecting element and the flange of the column, said column connecting element having a free end opposite from said outer corner edge, the entirety of said free end of said column connecting element lying in said vertical plane, a reinforcing element extending between the column connecting element and the beam connecting element, said reinforcing element being positioned between the two rows of holes in the column connecting element, said reinforcing element extending along the column connecting element from the inner corner to substantially the upper free end of the column connecting element, said reinforcing element extending along the beam connecting element from the inner corner to substantially a free end of the beam connecting element.

14. Fitting according to claim 13, wherein said beam connecting element is provided with two rows of through holes, said reinforcing element extending along the beam connecting element between the two rows of through holes in the beam connecting element, each row of holes in the beam connecting element including a forwardmost hole located distally from the column connecting element, each of said forwardmost holes being offset inwardly towards the reinforcing element with respect to other holes in the respective row.

15. Fitting according to claim 13, including a brass plate for being positioned between the beam connecting element and the flange of the beam.

16. The fitting according to claim 13, wherein the beam connecting element includes a plurality of through holes formed in two rows for alignment with holes in the flange of the beam to provide a bolted connection between the beam connecting element and the flange of the beam.

17. Fitting for connecting together a beam and a column in a steel structure, comprising a one piece L-shaped bracket that includes a horizontal beam connecting element for being connected to a beam forming a part of a steel structure, and a vertical column connecting element for being connected to a column forming a part of the steel structure, said column connecting element and said beam connecting element intersecting to define an inner corner of the bracket, said horizontal beam connecting element having an outer surface adapted to face a flange of the beam and said vertical column connecting element having an outer surface adapted to face a flange of the column, said L-shaped bracket having an outer corner edge adapted to be positioned at a corner formed between the beam and the column, said outer corner edge being provided with a notch, said horizontal beam connecting element lying in a plane and said bracket being asymmetrical about said plane, said column connecting element having a plurality of through holes formed in two rows for alignment with holes in the column to provide a bolted connection between the column connecting element and the flange of the column, a reinforcing element extending between the column connecting element and the beam connecting element, said reinforcing element being positioned between the two rows of holes in the column connecting element, said reinforcing element extending along the column connecting element from the inner corner to substantially an upper free end of the column connecting element, said reinforcing element extending along the beam connecting element from the inner corner to substantially a free end of the beam connecting element.

18. The fitting according to claim 17, wherein the beam connecting element includes a plurality of through holes formed in two rows for alignment with holes in the flange of the beam to provide a bolted connection between the beam connecting element and the flange of the beam.

* * * * *